US009114542B2

(12) United States Patent
Vetter et al.

(10) Patent No.: US 9,114,542 B2
(45) Date of Patent: Aug. 25, 2015

(54) DETERMINING DEGREE OF DIRTINESS OF ELECTRICALLY DRIVEN CUTTING TOOLS

(75) Inventors: Ingo Vetter, Bad Camberg (DE); Holger Hild, Idstein (DE); Thomas Hohmann, Gelnhausen (DE)

(73) Assignee: Braun GmbH, Kronberg (DE)

( * ) Notice: Subject to any disclaimer, the term of this patent is extended or adjusted under 35 U.S.C. 154(b) by 808 days.

(21) Appl. No.: 12/377,575

(22) PCT Filed: Jul. 26, 2007

(86) PCT No.: PCT/EP2007/006622

§ 371 (c)(1), (2), (4) Date: Feb. 13, 2009

(87) PCT Pub. No.: WO2008/019754

PCT Pub. Date: Feb. 21, 2008

(65) Prior Publication Data

US 2011/0197455 A1 Aug. 18, 2011

(30) Foreign Application Priority Data

Aug. 14, 2006 (DE) ..... 10 2006 038 126

(51) Int. Cl.
*B26B 19/38* (2006.01)

(52) U.S. Cl.
CPC ..... *B26B 19/38* (2013.01); *B26B 19/388* (2013.01)

(58) Field of Classification Search
USPC ..... 30/196, 41; 171/3; 73/432.1
See application file for complete search history.

(56) References Cited

U.S. PATENT DOCUMENTS

| | | | | |
|---|---|---|---|---|
| 4,583,027 | A | 4/1986 | Parker et al. | |
| 5,274,735 | A * | 12/1993 | Okada | 388/815 |
| 5,632,087 | A | 5/1997 | Motohashi et al. | |
| 5,920,988 | A * | 7/1999 | Momose | 30/41 |
| 6,072,399 | A * | 6/2000 | Cimbal et al. | 340/635 |
| 2005/0146296 | A1 * | 7/2005 | Klemm et al. | 318/119 |

FOREIGN PATENT DOCUMENTS

| | | |
|---|---|---|
| DE | 197 43 853 | 11/1998 |
| DE | 698 08 400 | 7/2003 |
| DE | 102 29 319 | 1/2004 |
| EP | 0 908 278 | 3/2003 |
| JP | 04-314486 | 11/1992 |

* cited by examiner

*Primary Examiner* — Hezron E Williams
*Assistant Examiner* — Xin Zhong
(74) *Attorney, Agent, or Firm* — Jay Krebs

(57) ABSTRACT

Implementations of a method for determining a degree of dirtiness of a cutting tool that is driven in a back and forth motion by an electric motor include evaluating a parameter that corresponds to the motion of the cutting tool and that is used for controlling the electric motor. The degree of dirtiness is determined based on the parameter.

5 Claims, No Drawings

DETERMINING DEGREE OF DIRTINESS OF ELECTRICALLY DRIVEN CUTTING TOOLS

FIELD

The present invention relates to a method and apparatus for determining a degree of dirtiness of an electrically driven cutting tool, and more specifically to determining and indicating the degree of dirtiness of a cutting tool.

BACKGROUND

EP 0908278 B1 discloses a method for determining the quantity of clippings produced by an electrically driven cutting tool, wherein this determination is based on the notion that the current consumption of a d.c. motor driving the cutting tool is subjected to fluctuations that are caused by the individual cutting processes. These current fluctuations are measured, evaluated and used as a measure for the quantity of the produced clippings. If this method is realized in a hair cutting device, an indicating device is also activated after a certain reference value for the quantity of the produced clippings is reached in order to inform the user of the necessity to clean the hair cutting device.

DE 10229319 A1 discloses a method for controlling an oscillating electric motor that serves, for example, for driving an electric razor or an electric toothbrush. In this method, a coil of the electric motor is supplied with an electric current at a certain point in time in order to realize a magnetic field that originates from a first motor component and acts upon a second motor component in such a way that the second motor component carries out an oscillating movement relative to the first motor component. At the time, at which the coil is supplied with a current, at least one electric parameter of the coil is determined that is correlated with the state of motion of the first or the second motor component, for example, the voltage applied to the coil and/or the current flowing through the coil and/or the change of the current flowing through the coil as a function of the time. The future current supply to the coil, i.e., the control of the oscillating electric motor, takes place in dependence on the determined parameter(s). In addition, DE 10229319 A1 describes how the oscillation frequency and the oscillation amplitude of the motor components can be determined.

SUMMARY

Implementations of the present invention include methods for determining a degree of dirtiness of an electrically driven cutting tool that is driven by an electric motor in a back and forth motion. In some implementations, the method includes measuring a parameter that corresponds to the motion of the cutting tool, and that is used to control the electric motor, and determining the degree of dirtiness based on the parameter.

In some implementations, the parameter corresponds to an amplitude of the motion of the cutting tool.

In some implementations, the method further includes measuring changes in the parameter, and registering a change as a dirtying event if the amount of the change is greater than a threshold value. In some embodiments, the method of further includes defining a first and a second threshold value, comparing negative changes in the parameter with the first threshold value, and comparing positive changes of the parameter with the second threshold value. In some embodiments, the method further includes providing a counter for counting dirtying events, and weighting negative changes in the parameter higher than positive changes of the parameter during the counting. In some embodiments, a lack of either negative or positive changes of the parameter causes the weighting of the measured parameter changes with a different value.

In some implementations, the electric motor is one of an oscillating electric motor and a linear electric motor.

In other implementations, a method for determining a degree of dirtiness of an electrically driven cutting tool that is driven by an electric motor in a back and forth motion, includes determining a change in a parameter that corresponds to the motion of the cutting tool, and that is used to control the electric motor, and determining the degree of dirtiness based on the change in the parameter.

In some implementations, the method further includes determining whether the change is one of a positive change and a negative change, comparing the negative change with a first threshold value, and comparing the positive change with a second threshold value.

In some implementations, the method further includes providing a counter for counting dirtying events, and incrementing the counter based on the change in the parameter. In some embodiments, the method further includes weighting a negative change in the parameter higher than positive changes of the parameter during the counting.

DETAILED DESCRIPTION

The present invention discloses a method for determining a degree of dirtiness of a cutting tool that is driven by an oscillating electric motor or linear motor and carries out a back and forth motion, as well as a hair cutting device with such a cutting tool that features a device for determining the degree of dirtiness of its cutting tool.

In order to determine the degree of dirtiness of the cutting tool driven by an oscillating electric motor or linear motor, the inventive method utilizes at least one parameter that is conventionally determined by a control device for controlling the oscillating electric motor or linear motor and correlated with the respective state of motion of the cutting tool. The parameter is determined in dependence on continuous measurements of the motor current and/or the motor voltage and/or the change of the motor current as a function of the time, for example, as described in DE 10229319 A1. The control of the oscillating electric motor or linear motor also causes the cutting tool driven by the oscillating electric motor or linear motor to always move with the correct frequency and/or amplitude during load fluctuations, i.e., with the frequency and/or amplitude, to which the cutting tool with its drive is adapted. The inventive method is based on the notion that changes of the parameter are the result of changes of the instantaneous load of the cutting tool, wherein these load fluctuations may be caused by a change of the operating state (idle running, cutting, switching the drive on or off, etc.), as well as by each individual cutting event.

The invention is described below with reference to an example in the form of a razor, the cutting tool of which carries out a back and forth motion and is driven by an oscillating electric motor or linear motor. However, the invention naturally can also be used in other cutting tools. The razor contains a dirtiness indicator that is activated, if so required, in order to clean the razor in a timely fashion. The steps described below are carried out continuously, wherein the oscillation frequency of the motor component of a razor lies, for example, at 400 Hz and a parameter that is correlated with the respective state of motion of the cutting tool is preferably determined at least during each semi-oscillation.

In accordance with implementations of the present disclosure, the method includes obtaining a parameter that is correlated with the respective amplitude of the motion of the cutting tool. This may be realized, for example, as described in DE 10229319 A1. For example, the voltage applied to a coil of the electric motor and/or the current flowing through the coil and/or the change of the current flowing through the coil as a function of the time is determined at least during each semi-oscillation of the cutting tool and a parameter for the amplitude of the motion of the cutting tool is determined thereof.

In accordance with implementations of the present disclosure, the determined parameter is stored and a subsequently determined parameter is compared with the previously stored parameter. A thusly determined parameter change may have a positive or negative sign and results from load fluctuations during the shaving process that may be caused by the individual cutting processes or by different pressures exerted upon the skin by the cutting head. The parameters for controlling the oscillating motor that oscillates with approximately 400 Hz are measured with a frequency of 800 Hz because a parameter is measured during each semi-oscillation in the described exemplary embodiment. However, the evaluation of the parameters for determining the degree of dirtiness does not have to be carried out with the same frequency. For example, only each second parameter may be used for the evaluation. In this case, a stored parameter therefore would only be compared with the parameter after the next parameter. The frequency of the evaluation of the parameter for determining the degree of dirtiness therefore may be lower than the frequency of the parameter measurement.

In accordance with implementations of the present disclosure, the parameter change is compared with at least one threshold value. It is preferred that a negative parameter change is compared with a first threshold value and a positive parameter change is compared with a second threshold value. A positive parameter change is caused, for example, due to the fact that the contact pressure decreases while the cutting head is moved over the skin or lifted off the skin while shaving. The second threshold value is preferably chosen such that not only the removal of the cutting head from the skin and the associated load alleviation of the drive can be detected, but small positive parameter changes that may be caused, if applicable, by interfering influences are also suppressed. Positive parameter changes that are greater than the second threshold value therefore mean that the cutting head was in contact with the skin and therefore has become dirty, for example, due to sebum. A negative parameter change may be caused, for example, by cutting at least a certain number of beard hairs such that the cutting tool was decelerated. Negative parameter changes that are greater than the first threshold value therefore mean that beard hairs were cut and the cutting head has become dirty with beard dust.

Each time the amount of the parameter change is greater than the first or the second threshold value, a pulse is generated that is counted by a dirtiness counter. Pulses generated due to negative parameter changes are preferably weighted higher than the pulses generated due to positive parameter changes in the up-count of the dirtiness counter because dirtiness due to beard dust creates a greater need to clean the cutting head than dirtiness due to sebum. Alternatively or additionally to the different weighting of the events causing the dirtiness, it would also be possible to choose the amount of the first threshold value differently from the amount of the second threshold value.

If no negative parameter changes are detected but positive parameter changes are present, this may be an indicator for the user having a very soft beard such that the cutting of the soft hair does not cause any detectable parameter change. Despite the lack of negative parameter changes, beard hairs are naturally cut off and the cutting device becomes dirty. This can be taken into consideration by adapting the weighting of the pulses generated by positive parameter changes such that the actual dirtiness resulting from softer beard hairs is taken into consideration. Suitable weighting values can be stored in a memory.

In accordance with implementations of the present disclosure, the count of the dirtiness counter is compared with a reference value that corresponds to a certain dirtiness of the cutting tool. An indicator is activated if this reference value is reached or exceeded. This can be conventionally realized with an optical, acoustical or similar indicator.

The invention claimed is:

1. A method of indicating to a user that an electrically driven cutting tool that is driven by an electric motor in a back and forth motion has become dirty, comprising:

measuring a parameter that corresponds to the motion of the cutting tool, and that is used to control the electric motor, wherein said parameter is selected from the group consisting of voltage applied to a coil of the electric motor, current flowing through said coil, the change of current flowing through said coil as a function of time, and combinations thereof;

measuring changes in the parameter;

registering a change in the parameter as a dirtying event if the amount of the change is greater than a threshold value;

counting dirtying events;

comparing the number of dirtying events to a reference number; and activating an indicator if the number of dirtying events meets or exceeds the reference number; further comprising:

defining a first and a second threshold value;

comparing negative changes in the parameter with the first threshold value; and comparing positive changes of the parameter with the second threshold value, and providing a counter for counting dirtying events; and weighting negative changes in the parameter higher than positive changes of the parameter during the counting.

2. The method of claim 1, wherein a lack of either negative or positive changes of the parameter causes the weighting of the measured parameter changes with a different value.

3. The method of claim 1, wherein the electric motor is one of an oscillating electric motor and a linear electric motor.

4. A method of indicating to a user that an electrically driven cutting tool that is driven by an electric motor in a back and forth motion has become dirty, comprising:

determining a change in a parameter that corresponds to the motion of the cutting tool, and that is used to control the electric motor, wherein said parameter is selected from the group consisting of voltage applied to a coil of the electric motor, current flowing through said coil, the change of current flowing through said coil as a function of time, and combinations thereof;

measuring changes in the parameter;

registering a change in the parameter as a dirtying event if the amount of the change is greater than a threshold value;

counting dirtying events;

comparing the number of dirtying events to a reference number; and activating an indicator if the number of dirtying events meets or exceeds the reference number; further comprising:

determining whether the change is one of a positive change and a negative change;

comparing the negative change with a first threshold value;

comparing the positive change with a second threshold value;

providing a counter for counting dirtying events;

incrementing the counter based on the change in the parameter; and further, weighting a negative change in the parameter higher than positive changes of the parameter during the counting.

5. The method of claim 4, wherein the electric motor is one of an oscillating electric motor and a linear electric motor.

* * * * *